US009646550B2

(12) United States Patent
Kim et al.

(10) Patent No.: US 9,646,550 B2
(45) Date of Patent: May 9, 2017

(54) LIQUID CRYSTAL DISPLAY DEVICE AND METHOD OF DRIVING THE SAME

(75) Inventors: Min-Kyu Kim, Goyang-si (KR); Young-Ho Kim, Paju-si (KR); Sung-Jo Koo, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 405 days.

(21) Appl. No.: 13/314,698

(22) Filed: Dec. 8, 2011

(65) Prior Publication Data

US 2012/0146967 A1 Jun. 14, 2012

(30) Foreign Application Priority Data

Dec. 13, 2010 (KR) ..... 10-2010-0126927

(51) Int. Cl.
*G09G 3/36* (2006.01)

(52) U.S. Cl.
CPC ..... *G09G 3/3614* (2013.01); *G09G 3/3688* (2013.01); *G09G 2310/0283* (2013.01); *G09G 2310/0286* (2013.01)

(58) Field of Classification Search
CPC ..... G09G 5/00; G09G 3/36; G09G 3/3659; G09G 2310/0278; G06F 3/038
See application file for complete search history.

(56) References Cited

U.S. PATENT DOCUMENTS 6,249,270 B1 * 6/2001 Ito ..... G09G 3/3688 345/100
6,310,592 B1 * 10/2001 Moon et al. ..... 345/87
6,459,417 B1 * 10/2002 Orisaka ..... G09G 3/3677 345/100
7,136,040 B1 * 11/2006 Park ..... G02F 1/1345 345/100

(Continued)

FOREIGN PATENT DOCUMENTS

CN 1652193 A 8/2005
CN 1941061 A 4/2007

(Continued)

OTHER PUBLICATIONS

Office Action issued in Chinese Patent Application No. 201110424136.1, mailed Jul. 22, 2014, 11 pages.

(Continued)

*Primary Examiner* — Kent Chang
*Assistant Examiner* — Sujit Shah
(74) *Attorney, Agent, or Firm* — Brinks Gilson & Lione

(57) ABSTRACT

The liquid crystal display device includes a display panel for displaying a picture thereon, first to (n)th upper data drive ICs for supplying pixel voltages to one side of each data line in the display panel, first to (n)th bottom data drive ICs for supplying pixel voltages to the other side of each data line, a first timing controller for generating an upper data control signal and for controlling operation of the upper data drive ICs, and a second timing controller for generating a bottom (Continued)

data control signal and for controlling operation of the bottom data drive ICs wherein at least one of the first and second timing controllers analyzes the picture data applied thereto and controls the polarities of the pixel voltages to be forwarded from the upper data drive ICs and the bottom data drive ICs with reference to the result of the analysis.

17 Claims, 11 Drawing Sheets

(56) References Cited

U.S. PATENT DOCUMENTS

2002/0060655 A1* 5/2002 Moon ..... 345/87
2002/0084965 A1* 7/2002 Park ..... 345/87
2004/0090435 A1* 5/2004 Kim ..... 345/204
2006/0022968 A1* 2/2006 Kondo et al. ..... 345/211
2006/0055645 A1* 3/2006 Kim ..... 345/87
2007/0091059 A1* 4/2007 Kang ..... 345/102
2007/0152942 A1* 7/2007 Yamagishi ..... 345/96
2009/0322715 A1* 12/2009 Hirato ..... G02F 1/136259 345/204
2010/0225831 A1* 9/2010 Takeuchi ..... G02F 1/136213 348/739
2010/0259522 A1* 10/2010 Weng ..... G09G 3/3648 345/208
2011/0148852 A1* 6/2011 Kim ..... 345/213
2012/0146967 A1* 6/2012 Kim ..... G09G 3/3688 345/204

FOREIGN PATENT DOCUMENTS

CN 101136189 A 3/2008
CN 100485759 C 5/2009
CN 100573649 C 12/2009
KR 1020020007577 A 1/2002
KR 1020070036409 A 4/2007

OTHER PUBLICATIONS

Office Action issued in corresponding Chinese Patent Application No. 201110424136.1, mailed Dec. 3, 2013, 12 pages.
Office Action issued in corresponding Korean Patent Application No. 10-2010-0126927, mailed Apr. 22, 2013.

* cited by examiner

LIQUID CRYSTAL DISPLAY DEVICE AND METHOD OF DRIVING THE SAME

CROSS REFERENCE TO RELATED APPLICATION

This application claims the benefit of the Patent Korean Application No. 10-2010-0126927, filed on Dec. 13, 2010, which is hereby incorporated by reference as if fully set forth herein.

BACKGROUND OF THE DISCLOSURE

Field of the Disclosure

The present disclosure relates to liquid crystal display devices, and more particularly to a liquid crystal display device which can improve a pixel charge rate and a picture quality by controlling phases between polarity inverting control signals.

Discussion of the Related Art

As a display device becomes larger, lengths between gate lines and data lines of the display device increase relatively. Since resistance of the data line and capacity of a capacitor increase as the length of the data line becomes the longer, making a portion of the data line positioned far from an output terminal of the data driver to have a pixel voltage with relatively great distortion supplied thereto, the charge rate of the pixel connected to the data line portion can not but be poor, to cause a problem of a poor picture quality.

SUMMARY OF THE DISCLOSURE

A liquid crystal display device includes a display panel for displaying a picture thereon, first to (n)th upper data drive ICs for supplying pixel voltages to one side of each data line in the display panel, respectively, first to (n)th bottom data drive ICs for supplying pixel voltages to the other side of each data line respectively, a first timing controller for generating an upper data control signal and supplying the upper data control signal to the upper data drive ICs for controlling operation of the upper data drive ICs, and a second timing controller for generating a bottom data control signal and supplying the bottom data control signal to the bottom data drive ICs for controlling operation of the bottom data drive ICs, wherein at least one of the first and second timing controllers analyzes the picture data applied thereto and controls the polarities of the pixel voltages to be forwarded from the upper data drive ICs and the bottom data drive ICs with reference to the result of the analysis.

A method of driving a liquid crystal display device includes generating an upper data control signal and supplying the upper data control signal to first to (n)th upper data drive ICs for controlling operation of the upper data drive ICs from a first timing controller; generating a bottom data control signal and supplying the bottom data control to first to (n)th bottom data drive ICs for controlling operation of the bottom data drive ICs from a second timing controller; supplying pixel voltages to one side of each data lines in a display panel from the upper data drive ICs; and supplying pixel voltages to other side of each data lines in the display panel from the bottom data drive ICs, wherein at least one of the first and second timing controllers analyzes the picture data applied thereto and controls the polarities of the pixel voltages to be forwarded from the upper data drive ICs and the bottom data drive ICs with reference to the result of the analysis.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure. In the drawings.

DESCRIPTION OF EXEMPLARY EMBODIMENTS

Reference will now be made in detail to the specific embodiments of the present invention, examples of which are illustrated in the accompanying drawings. Wherever possible, the same reference numbers will be used throughout the drawings to refer to the same or like parts.

Figure 1:
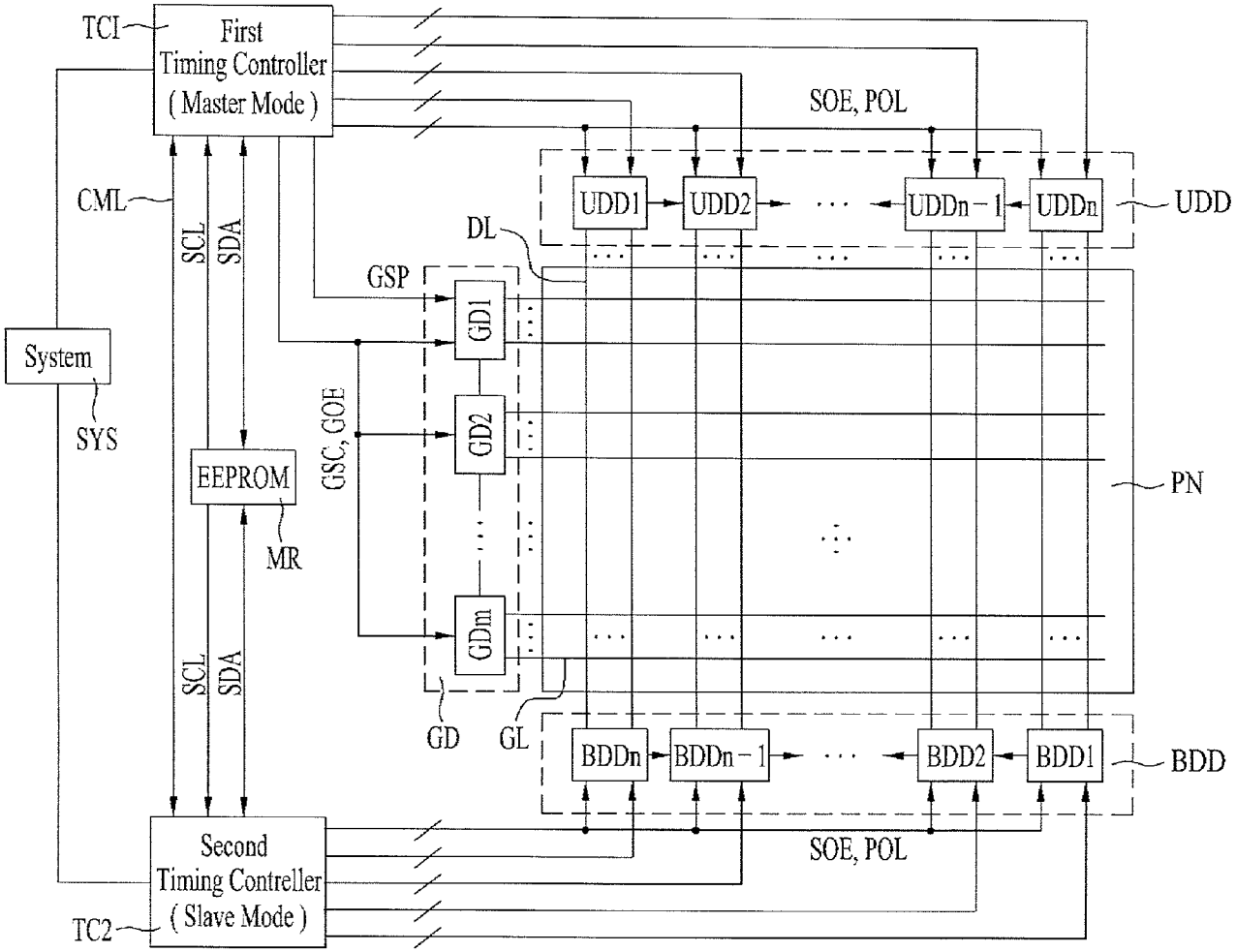
FIG. 1 illustrates a circuit diagram of a liquid crystal display device in accordance with a preferred embodiment of the present invention.

FIG. 1 illustrates a circuit diagram of a liquid crystal display device in accordance with a preferred embodiment of the present invention.

Referring to FIG. 1, the liquid crystal display device includes a display panel PN having a plurality of pixels defined by a plurality of gate lines GL and a plurality of data lines DL running perpendicular to each other, a plurality of gate drive ICs GD1~GDm for forwarding scan pulses in succession for driving the gate lines GL in succession, a plurality of upper data drive ICs UDD1~UDDn for supplying pixel voltages to one side of the data lines DL in the display panel PN respectively, a plurality of bottom data drive ICs BDD1~BDDn for supplying pixel voltages to the other side of the data lines DL in the display panel PN respectively, a first timing controller TC1 for generating an upper data control signal and supplying the same to the upper data drive ICs UDD1~UDDn for controlling operation of the upper data drive ICs UDD1~UDDn, and a second timing controller TC2 for generating a bottom data control signal and supplying the same to the bottom data drive ICs BDD1~BDDn for controlling operation of the bottom data drive ICs BDD1~BDDn.

In this instance, the bottom data driver BDD including the bottom data drive ICs BDD1~BDDn can be constructed by using the upper data drive ICs UDD1~UDDn.

Figure 2:
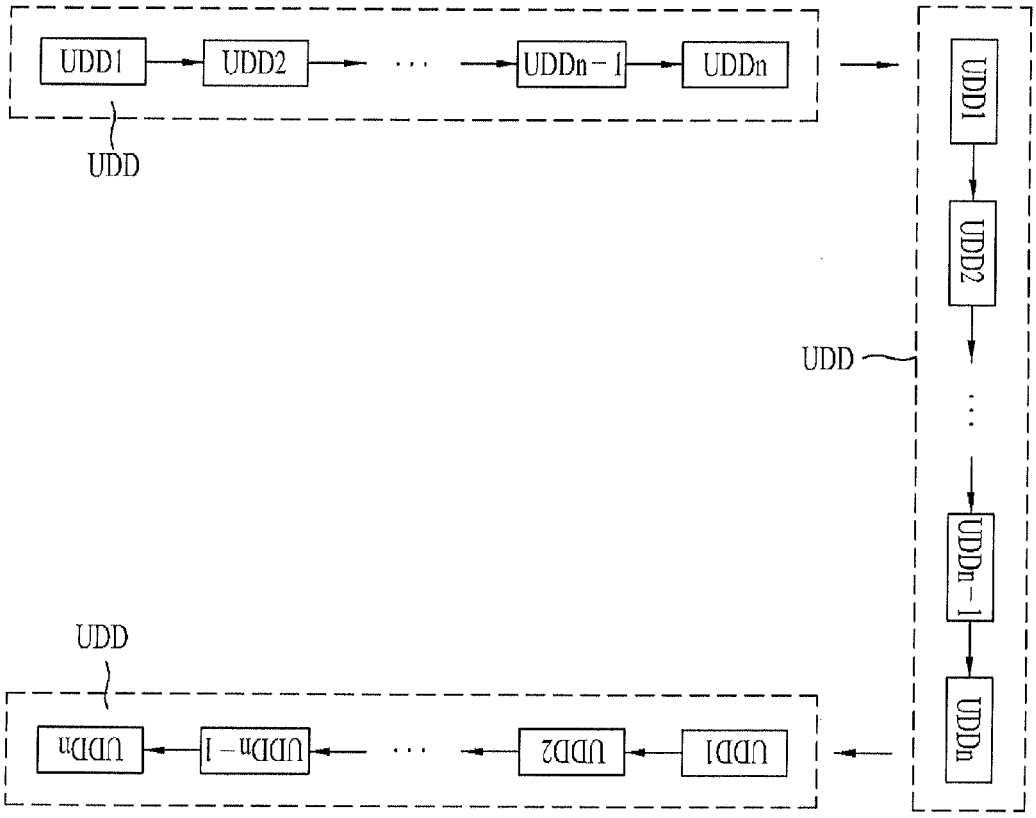
FIG. 2 illustrates a diagram showing a process for constructing a bottom data driver by using an upper data driver.

That is, FIG. 2 illustrates a diagram showing a process for constructing a bottom data driver by using an upper data driver, in which the upper driver UDD is turned by 180 degrees and attached to a bottom side of the display panel PN to construct the bottom data driver BDD. That is, two identical data drivers are provided, and one of the data drivers is attached to a top side of the display panel PN to construct the upper data driver UDD, and the other one of the data drivers is turned by 180 degrees and attached to the bottom of the display panel PN to construct the bottom data driver BDD.

Figure 3:
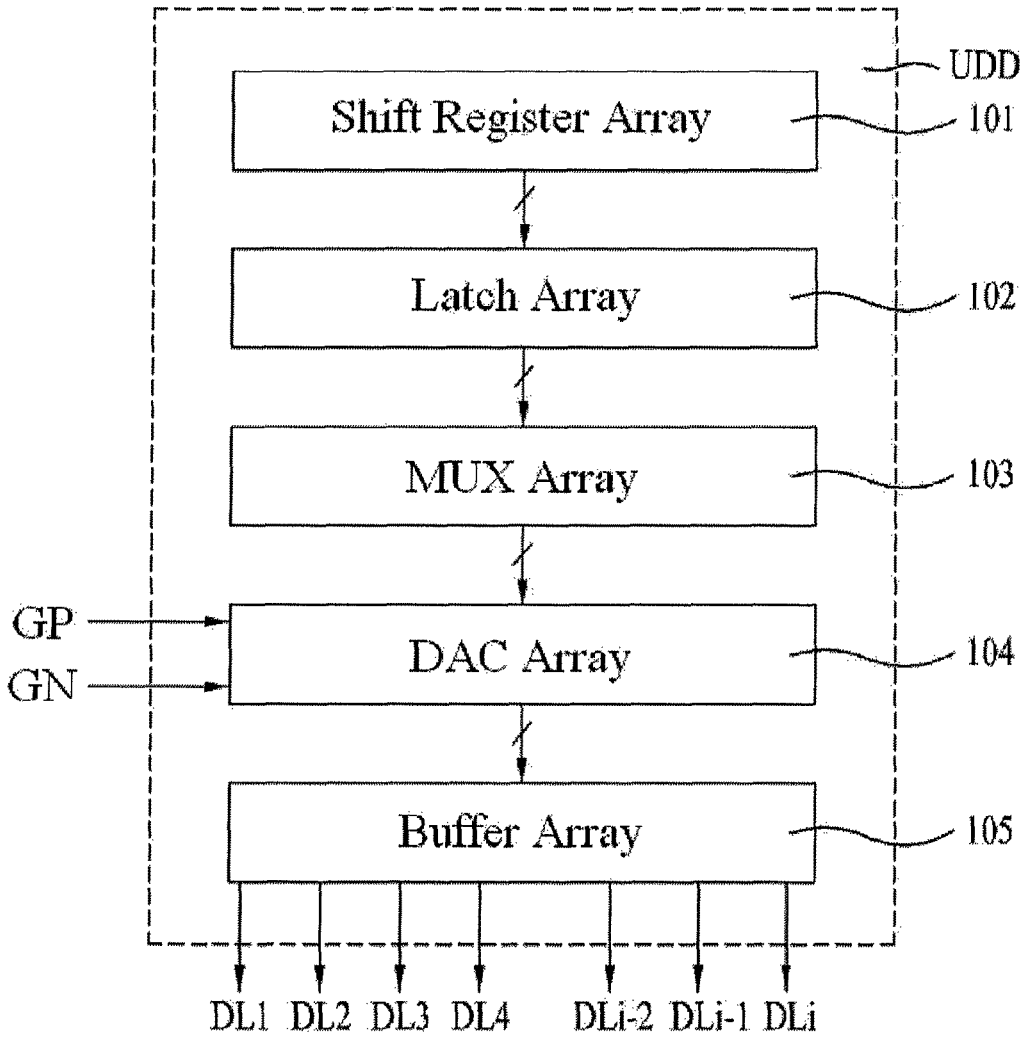
FIG. 3 illustrates a block diagram showing an upper data driver having the upper data drive ICs in FIG. 1, in detail.

FIG. 3 illustrates a block diagram showing an upper data driver DD having the upper data drive ICs UDD1~UDDn in FIG. 1 in detail, including a shift register array 101, a latch array 102, an MUX array 103, a digital-to-analog converter array 104 (hereafter, DAC array), and a buffer array 105.

The shift register array 101 generates sampling clocks by shifting source start pulses SSP from the first timing controller TC1 in succession according to source shift clocks SSC.

The latch array 102 samples picture data from the first timing controller TC1 in response to the sampling clock from then shift register array 101, and latches one horizontal line portion of the picture data sampled thus. The latch array 102 forwards the one horizontal line portion of the picture data latched thus at a time in response to a source output enable signal SOE from the first timing controller TC1.

The MUX array 103 forwards the picture data from the latch array 102 in blocks of horizontal periods as they are, or after shifting each of output lines to a right side by one. If the picture data from the latch array 102 are data of an odd numbered horizontal period, the MUX array 103 forwards the one line portion of the picture data from the latch array 102 as they are. Different from this, if the picture data from the latch array 102 are data of an even numbered horizontal period, the MUX array 103 forwards the one line portion of the picture data from the latch array 102 after shifting the one horizontal line portion of the picture data to a right side output line by one.

The DAC array 104 decodes the picture data from the MUX array 103 into analog values, and selects a positive gamma compensating voltage GP or a negative gamma compensating voltage GL of the analog values decoded thus in response to a polarity inversion control signal from the first timing controller TC1. That is, after the DAC array 104 converts the digital data from the MUX array 103 into the positive gamma compensating voltage GP or the negative gamma compensating voltage GN, the DAC array 104 converts the digital data having the output lines thereof shifted by the MUX array 103 into the positive gamma compensating voltage GP or the negative gamma compensating voltage GN.

The converted positive gamma compensating voltage GP or the negative gamma compensating voltage GN are supplied to the data lines DL1~DLi through the buffer array 105, respectively.

In the meantime, the bottom data driver BDD having the bottom data drive ICs BDD1~BDDn has a configuration identical to the upper data driver UDD, except that the bottom data driver BDD is controlled by the second timing controller TC2 instead of the first timing controller TC1.

The gate driver GD having a plurality of the gate drive ICs GD1~GDm supplies the scan pulse to the gate lines in succession by using a gate start pulse GSP, a gate shift clock GSC, and a gate output enable GOE from the timing controller.

The first timing controller TC1 re-aligns the picture data from a system SYS and supplies the picture data re-aligned thus to the upper data drive ICs UDD1~UDDn matched to respective timings, and the upper data drive ICs UDD1~UDDn generates the pixel voltages based on the picture data from the first timing controller TC1. And, the first timing controller TC1 generates an upper data control signal and a gate control signal by using a horizontal synchronizing signal Hsync, a vertical synchronizing signal Vsync, and a clock signal CLK applied from the system SYS to the first timing controller TC1.

The upper data control signal includes a dot clock, a source start pulse SSP, a source shift clock SSC, a source enable SOE and a polarity inversion control signal POL. And the gate control signal includes a gate start pulse GSP, a gate shift clock GSC, and a gate output enable GOE.

The second timing controller TC2 re-aligns the picture data from the system SYS and supplies the picture data re-aligned thus to the bottom data drive ICs BDD1~BDDn matched to respective timings, and the bottom data drive ICs BDD1~BDDn generates the pixel voltages based on the picture data from the second timing controller TC2. And, the second timing controller TC2 generates a bottom data control signal and a gate control signal by using a horizontal synchronizing signal Hsync, a vertical synchronizing signal Vsync, and a clock signal CLK applied from the system SYS to the second timing controller TC2.

The bottom data control signal includes a dot clock, a source start pulse SSP, a source shift clock SSC, a source enable SOE and a polarity inversion control signal POL. And the gate control signal includes a gate start pulse GSP, a gate shift clock GSC, and a gate output enable GOE.

The first timing controller TC1 supplies the picture data starting from the upper data drive IC positioned at one side edge of the display panel PN to the upper data drive IC positioned at the other side edge of the display panel PN in succession. Opposite to this, the second timing controller TC2 supplies the picture data starting from the bottom data drive IC positioned at the other side edge of the display panel PN to the bottom data drive IC positioned at one side edge of the display panel PN in succession. For an example, the first timing controller TC1 supplies the picture data starting from the first upper data drive IC to the (n)th upper data drive IC in succession, and the second timing controller TC2 supplies the picture data starting from the first bottom data drive IC to the (n)th bottom data drive IC in succession. In this instance, the first timing controller TC1 and the second timing controller TC2 forward the picture data in orders opposite to each other. That is, the first timing controller TC1 forwards the picture data starting from the picture data of the first upper data drive IC UDD1 to the picture data of the (n)th upper data drive IC UDDn in succession, and the second timing controller TC2 forwards the picture data starting the picture data of the first bottom data drive IC BDD1 to the picture data of the (n)th bottom data drive IC BDDn in succession. Or, alternatively, the second timing controller TC2 drives starting from the (n)th bottom data drive IC BDDn to the first bottom data IC BDD1 in a reverse order, whereby the second timing controller TC2 is made to forwards the picture data in an order the same with the first timing controller TC1.

In this instance, the picture data supplied to one side of one data line is the same with the picture data supplied to the other side of the one data line.

The first and second timing controllers TC1 and TC2 are operated either in a master mode or slave mode in response to an external mode control signal, respectively. The first and second timing controllers TC1 and TC2 are operated in modes opposite to each other. That is, when the first timing controller TC1 is operated in the master mode, the second timing controller TC2 is operated in the salve mode, and vice versa.

In detail, at the time the first timing controller TC1 is operated in the master mode, the first timing controller TC1 generates a gate control signal for controlling operation of the gate drive ICs GD1~GDm in addition to the picture data, and the upper data control signal, and forwards the same to the gate drive ICs GD1~GDm. At this time, the second timing controller TC2 is operated in the slave mode, wherein, the second timing controller TC2 forwards the picture data and the bottom data control signal only to the bottom data drive ICs BDD1~BDDn.

Opposite to this, at the time the second timing controller TC2 is operated in the master mode, the second timing controller TC2 generates a gate control signal for controlling operation of the gate drive ICs GD1~GDm in addition to the picture data, and the bottom data control signal, and forwards the same to the gate drive ICs GD1~GDm. At this time, the first timing controller TC1 is operated in the slave mode, wherein, the first timing controller TC1 forwards the picture data and the upper data control signal only to the upper data drive ICs UDD1~UDDn.

In other words, the first timing controllers TC1 or the second timing controllers TC2 forward the picture data, the data control signal, and the gate control signal when operated in the master mode. However, the first timing controllers TC1 or the second timing controllers TC2 forward the picture data, and the data control signal, except the gate control signal when operated in the master mode, respectively.

Connected between the first timing controller TC1 and the second timing controller TC2, there is at least one communication line CML. By communicating through the communication line CML to each other, outputs from the first timing controller TC1 and the second timing controller TC2 can be synchronized.

That is, the timing controller in the master mode (the first timing controllers TC1 or the second timing controllers TC2) can control some of operation of the timing controller in the slave mode (the second timing controllers TC2 or the first timing controllers TC1) through the communication line CML. For an example, when the first timing controllers TC1 is in the master mode and the second timing controllers TC2 is in the slave mode, the first timing controller TC1 in the master mode controls output timings of the first timing controller TC1 for forwarding the pixel voltages to the data lines DL as well as controls the output timings of the second timing controller TC2 in the slave mode for forwarding the pixel voltages to the data lines DL through the communication line CML, and vice versa. For this, the timing controller in the master mode controls the timing controller in the slave mode such that the two timing controllers supply source output enables to the upper and bottom data drive ICs UDD1~UDDn and BDD1~BDDn at a time, respectively.

FIG. 1 illustrates an example in which the first timing controller TC1 is operated in the master mode, and the second timing controller TC2 is operated in the slave mode. However, opposite to this, the first timing controller TC1 can be operated in the slave mode, and the second timing controller TC2 can be operated in the master mode.

Moreover, the liquid crystal display device of the present invention can further include a memory MR having various kinds of correction data stored therein for correction of the picture data from the first and second timing controllers TC1 and TC2. In this instance, a time the timing controller in the master mode reads in the correction data from the memory MR is different from a time the timing controller in the slave mode reads in the correction data from the memory MR.

The memory MR can be an EEPROM (Electrically Erasable Programmable Read-Only Memory).

Figure 4:
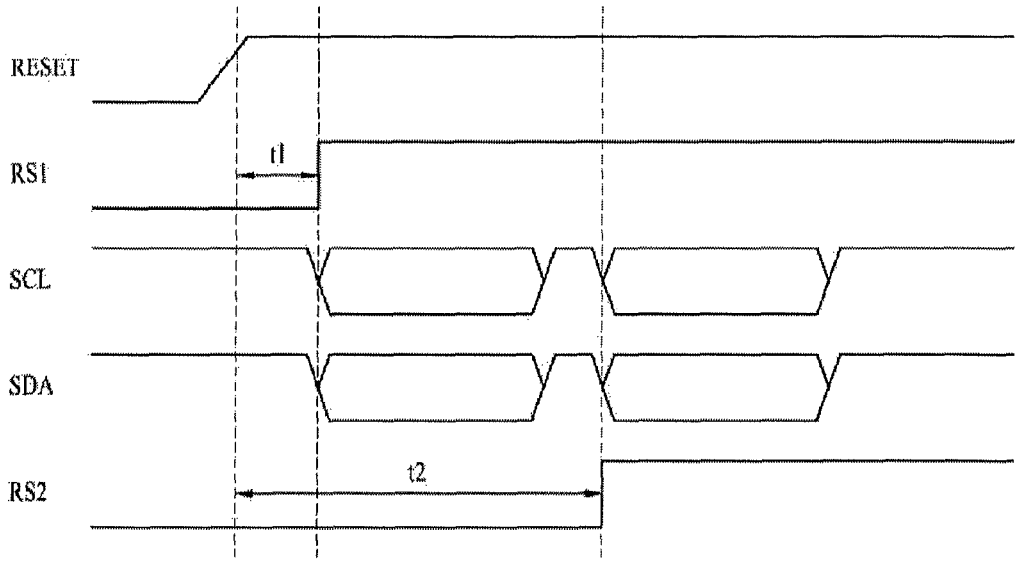
FIG. 4 illustrates a timing diagram of a read control signal being supplied to a timing controller.

FIG. 4 illustrates a timing diagram of a read control signal (RS1, RS2) being supplied to a timing controller, for controlling to read in the correction data from the memory MR.

Referring to FIG. 4, at the time the timing controller is operated in the master mode, the timing controller reads in the correction data from the memory MR after a t1 period in response to a first read control signal RS1 enabled after the t1 period. Opposite to this, at the time the timing controller is operated in the slave mode, the timing controller reads in the correction data from the memory MR after a t2 period in response to a second read control signal RS2 enabled after the t2 period. For an example, at the time the first timing controller TC1 is operated in the master mode and the second timing controller TC2 is operated in the slave mode, the first timing controller TC1 communicates with the memory MR in the $I^{2C}$ communication system in a first read time period after the t1 period in response to the first read control signal RS1 supplied from an outside, so as to read in the correction data from the memory MR. Opposite to this, the second timing controller TC2 communicates with the memory MR in the I2C communication system in a second read time period after the t2 period in response to the second read control signal RS2 supplied from an outside, so as to read in the correction data from the memory MR. In this instance, the first read time period of the first timing controller TC1 for reading from the memory MR and the second read period of the second timing controller TC2 for reading from the memory MR do not overlap. In FIG. 4, an SCL denotes the source clock signal, and an SDA denotes a source data signal. The first and second timing controllers TC1 and TC2 read in source data signals which fall under correction data from the memory MR in response to the source clock signal, respectively.

As an alternative system, the timing controller in the master mode can control the first read time period in which the timing controller reads in the correction data from the memory MR, as well as control the second read time period of the timing controller in the slave mode through the communication line CML.

In the meantime, a RESET in FIG. 4 denotes a reset signal. At a moment a logic of the reset signal changes from low to high, the first and second timing controllers TC1 and TC2 become in states ready to read the memory.

In the meantime, polarity patterns of the pixels displayed on a screen of the display panel PN vary with characteristics of the picture data on one frame. In this instance, the characteristics of the picture data are the polarity patterns of the picture data on one frame, i.e., the polarity patterns of the pixel voltages to be supplied to entire pixels in one screen. The picture can be displayed in one dot inversion type or two dot inversion type depending on the polarity patterns of the pixel voltages.

Figure 5:
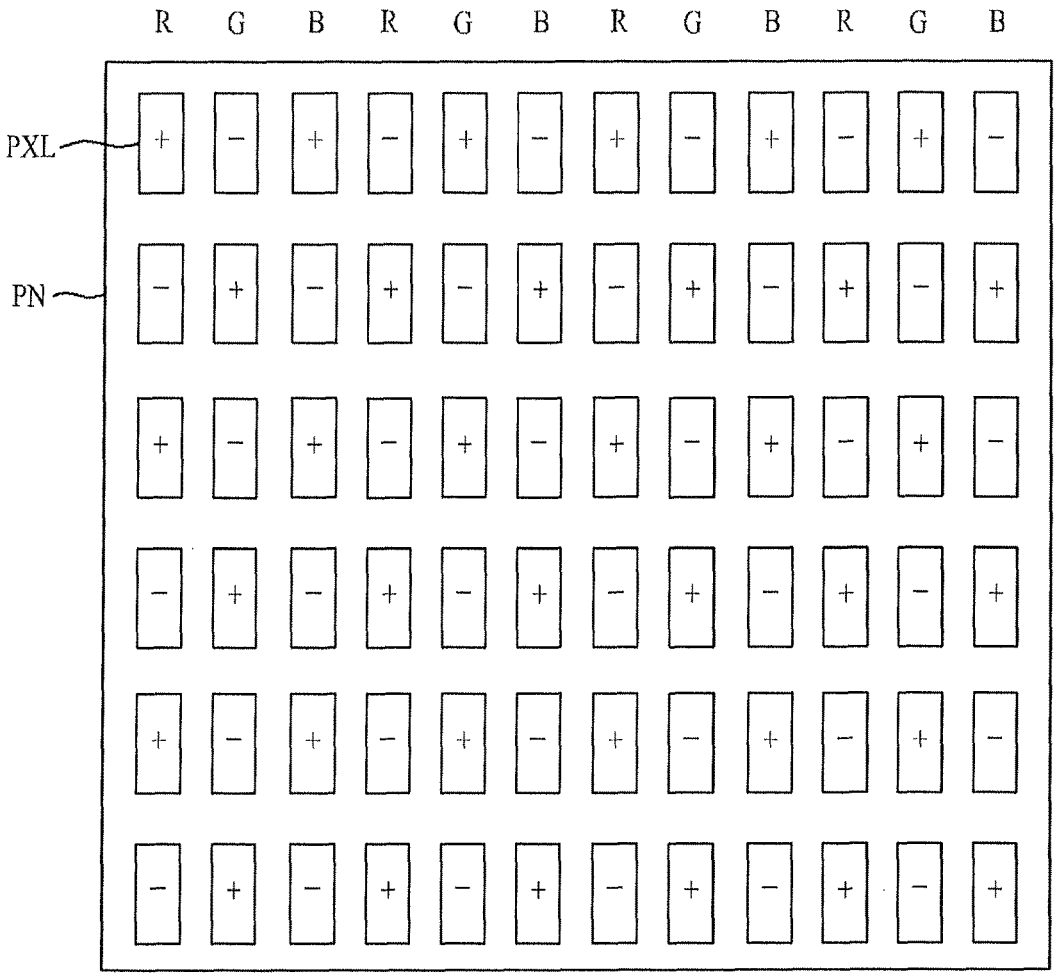
FIG. 5 illustrates a diagram showing a one dot inversion type picture.

FIG. 5 illustrates a diagram showing a one dot inversion type picture. As shown in FIG. 5, the pixel voltages being supplied to the pixels PXL arranged in a horizontal direction (An X-axis direction) have polarities inverted at every second pixel, and the pixel voltages being supplied to the pixels PXL arranged in a vertical direction (A Y-axis direction) have polarities inverted at every second pixel.

Figure 6:
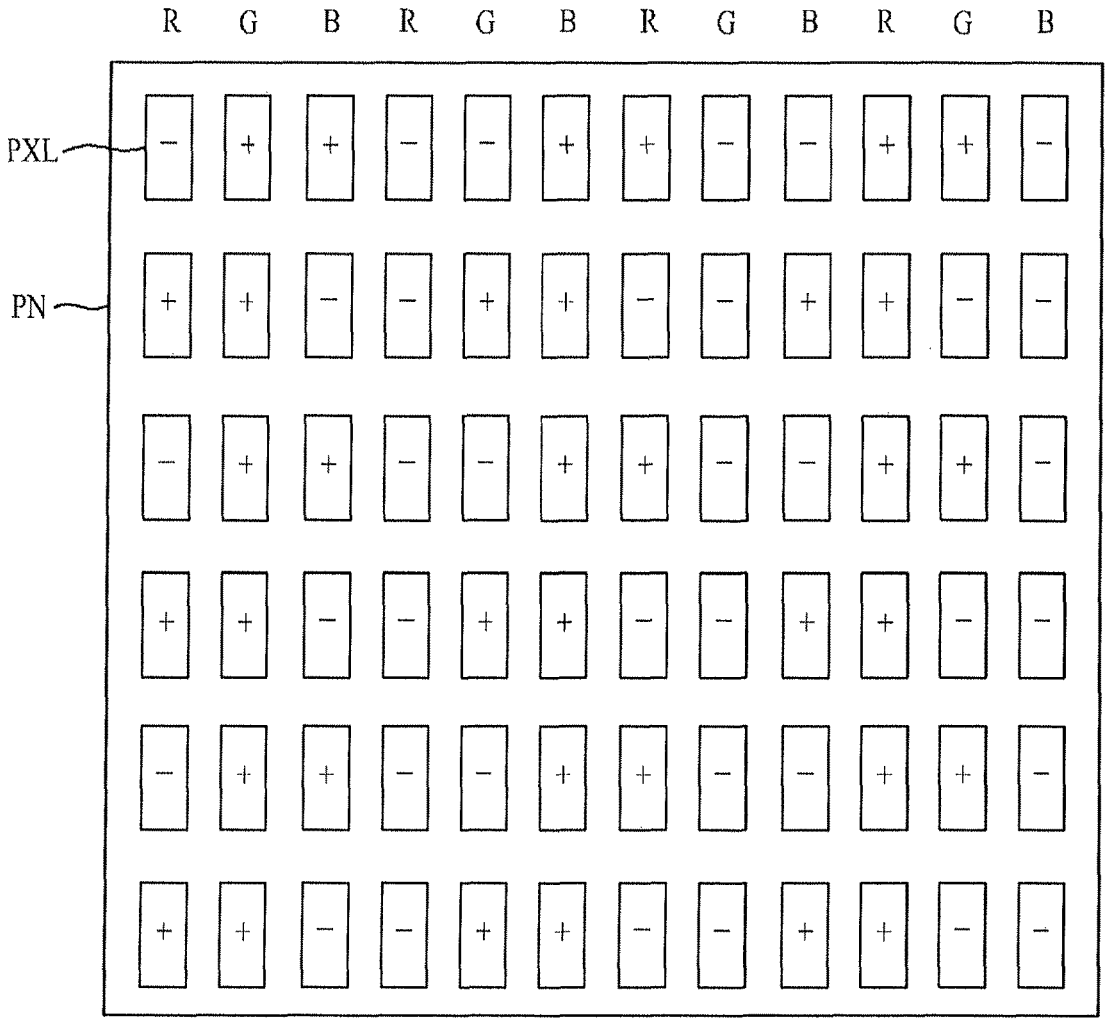
FIG. 6 illustrates a diagram showing a variant horizontal two dot inversion type picture.

FIG. 6 illustrates a diagram showing a variant horizontal two dot inversion type picture. As shown in FIG. 3, the pixel voltages being supplied to the pixels PXL arranged in the horizontal direction (An X-axis direction) have polarities inverted at every third pixel. In this instance, of the pixels PXL at odd numbered horizontal lines, two pixels at opposite outermost edges have the pixel voltages having the same polarities applied thereto. Opposite to this, the pixel voltages being supplied to the pixels PXL arranged in a vertical direction (A Y-axis direction) have the polarities inverted at every second pixel PXL or the same polarities. For an example, the pixel voltages being supplied to the pixels PXL on the odd numbered vertical lines have the polarities inverted at every one pixel PXL, and the pixel voltages being supplied to the pixels PXL on the even numbered vertical lines have the same polarities.

In order to display the polarity patterns shown in FIG. 5 or 6 on a screen regularly, the polarity inversion control signals POL forwarded from the first and second timing controllers TC1 and TC2 are required to have the same or inverse phases.

Figures 7A, 7B:
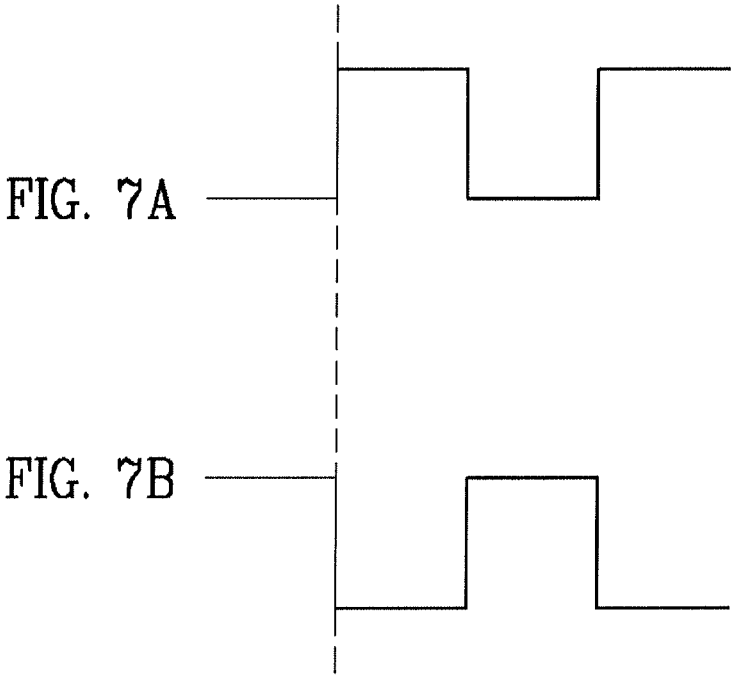
FIGS. 7A and 7B illustrates waveforms of polarity inversion control signals.

FIGS. 7A and 7B illustrates waveforms of a polarity inversion control signal.

The polarity inversion control signals POL from the first and second timing controllers TC1 and TC2 can be any one of the waveforms shown in FIGS. 7A and 7B. Or, the polarity inversion control signal POL from the first timing controller TC1 and the polarity inversion control signal POL from the second timing controller TC2 can have phases inversed to each other. For an example, the polarity inversion control signal POL from the first timing controller TC1 can have a waveform shown in FIG. 7A, and the polarity inversion control signal POL from the second timing controller TC2 can have a waveform shown in FIG. 7B.

In order to display the one dot inversion type picture shown in FIG. 5, it is required that the polarity inversion control signal POL being supplied to the upper data driver UDD and the polarity inversion control signal POL being supplied to the bottom data driver BDD have phases inverse to each other. This reason will be described in detail below.

That is, since the data lines are always set in even numbered sets, both a number of total output pins of the upper data drive ICs UDD1~UDDn in the upper data driver UDD and a number of total output pins of the bottom data drive ICs BDD1~BDDn in the bottom data driver BDD are also set in even numbered sets. Therefore, with reference to FIG. 5, when the one dot inversion type picture is to be displayed, the polarity of the pixel voltage from a first output pin and the polarity of the pixel voltage from a last output pin are always inversed to each other. In this instance, as shown in FIG. 2, since the bottom data driver BDD is an 180 degree rotated version of the upper data driver UDD, if the polarity inversion control signals POL having the same phases are supplied both to the upper data driver UDD and the bottom data driver BDD, the polarity patterns of the pixel voltages from the upper data driver UDD will be inversed to the polarity patterns of the pixel voltages from the bottom data driver BDD, causing a problem in that the pixel voltages having polarities different from each other are applied to opposite sides of each of the data lines by the upper data driver UDD and the bottom data driver BDD. For an example, with reference to FIG. 1, both the first output pin UDD1 (The output pin positioned at a leftmost side in FIG. 1) of the upper data driver UDD and the last output pin BDDn (The output pin positioned at a leftmost side in FIG. 1) of the bottom data driver BDD are connected to the first data line DL. If the polarity inversion control signals POL having identical phases are supplied both to the upper data driver UDD and the bottom data driver BDD, the polarity patterns of the pixel voltages from the upper data driver UDD will be inversed to the polarity patterns of the pixel voltages from the bottom data driver BDD, causing the output of the first output pin UDD1 of the upper data driver UDD inversed to the last output pin BDDn of the bottom data driver BDD. Therefor, if a positive polarity pixel voltage is forwarded from the first output pin of the upper data driver UDD, a negative polarity pixel voltage is forwarded from the last output pin of the bottom data driver BDD. As a result, pixel voltages having opposite polarities will be supplied to both sides of the same data line DL.

Because of this, in order to display the one dot inversion type picture shown in FIG. 5, the polarity inversion control signal POL being supplied to the upper data driver UDD and the polarity inversion control signal POL being supplied to the bottom data driver BDD are required to have phases inverse to each other.

Figure 8:
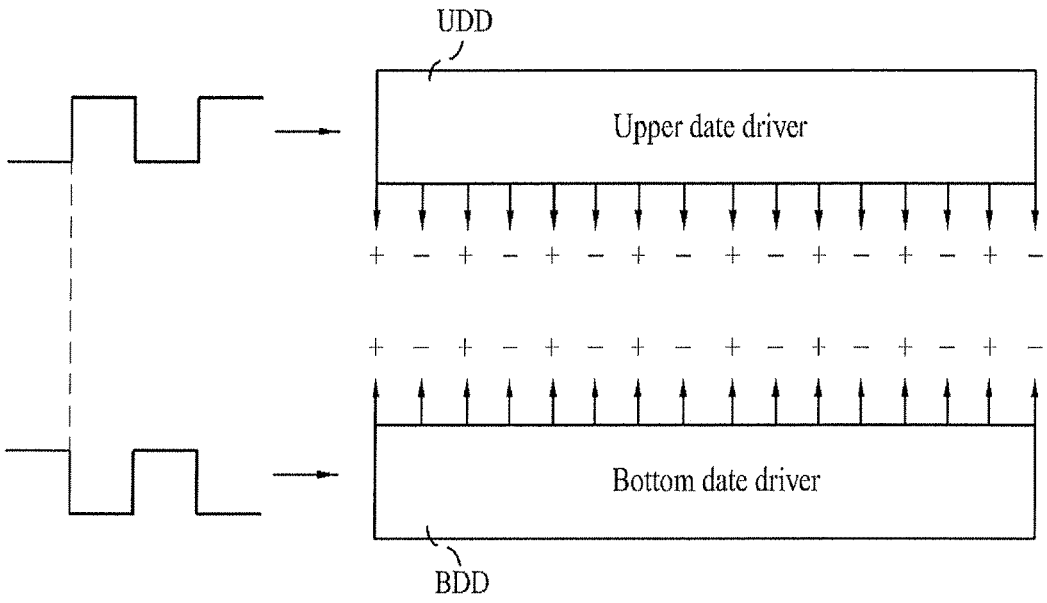
FIG. 8 illustrates waveforms of polarity inversion control signals for displaying the one dot inversion type picture shown in FIG. 5.

FIG. 8 illustrates waveforms of polarity inversion control signals for displaying the one dot inversion type picture shown in FIG. 5, wherefrom it can be known that, while the polarity inversion control signal POL shown in FIG. 7A is applied to the upper data driver UDD, the polarity inversion control signal POL having inversed phase shown in FIG. 7B is applied to the bottom data driver BDD. According to this, as can be seen from FIG. 8, the polarity patterns of the pixel voltages from the upper data driver UDD and the polarity patterns of the pixel voltages from the bottom data driver BDD are the same.

In the meantime, in order to display the variant two dot inversion type picture shown in FIG. 6, it is required that the polarity inversion control signal POL being supplied to the upper data driver UDD and the polarity inversion control signal POL being supplied to the bottom data driver BDD have the same phases maintained in odd numbered horizontal periods, and inverse phases to each other maintained in even numbered horizontal periods.

That is, as described before, since the data lines are always set in even numbered sets, both a number of total output pins of the upper data drive ICs UDD1~UDDn in the upper data driver UDD and a number of total output pins of the bottom data drive ICs BDD1~BDDn in the bottom data driver BDD are also set in even numbered sets. Therefore, with reference to FIG. 6, when the variant two dot inversion type picture is to be displayed, while the polarity of the pixel voltage from a first output pin in an even numbered horizontal period and the polarity of the pixel voltage from a last output pin are always same, the polarity of the pixel voltage from the first output pin in an odd numbered horizontal period and the polarity of the pixel voltage from the last output pin are always inverse to each other.

Figure 9:
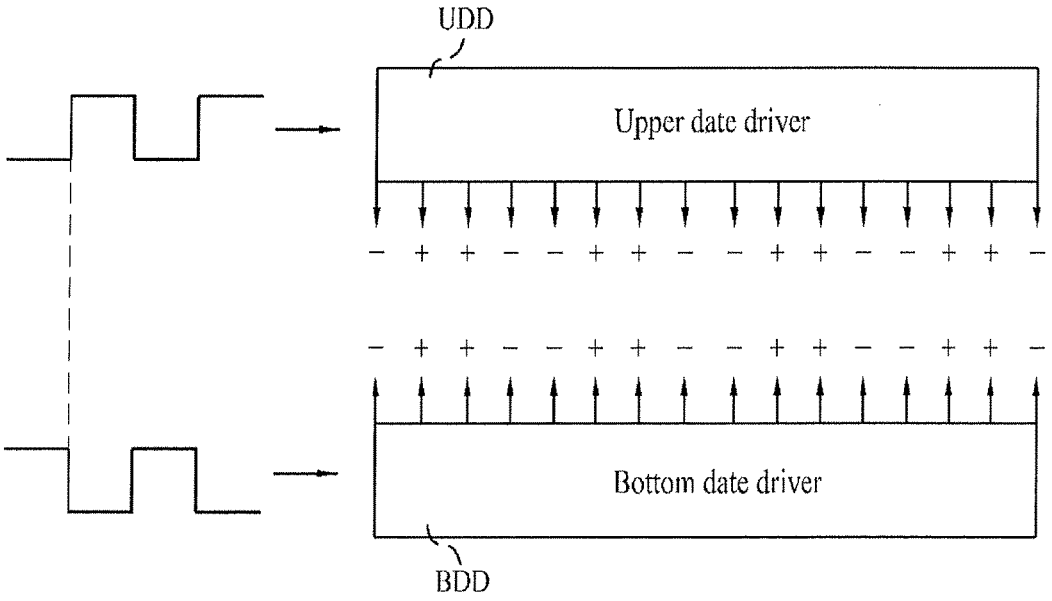
FIG. 9 illustrates waveforms of polarity inversion control signals in an odd numbered horizontal period at the time the variant two dot inversion type picture shown in FIG. 6 is displayed.

Therefore, FIG. 9 illustrates waveforms of polarity inversion control signals POL in an odd numbered horizontal period at the time the variant two dot inversion type picture shown in FIG. 6 is displayed. As can be seen, in order to display the variant two dot inversion type picture shown in FIG. 6, in the odd numbered horizontal period, the polarity inversion control signal POL shown in FIG. 7A is applied both to the upper data driver UDD and the bottom data driver BDD, so as to supply the polarity inversion control signals POL having identical phases to the upper data driver UDD and the bottom data driver BDD. In the meantime, though not shown, while the polarity inversion control signal POL shown in FIG. 7A is applied to the upper data driver UDD, the polarity inversion control signal POL having inversed phase shown in FIG. 7B is applied to the bottom data driver BDD.

In the meantime, the high period and the low period of the polarity inversion control signal POL used in the two dot inversion type can be set to have a length longer than the high period and the low period of the polarity inversion control signal POL used in the one dot inversion type.

As described before, the present invention controls modes of the polarity inversion control signal POL according to characteristics of the picture data. For this, at least one of the first and second timing controllers TC1 and TC2 of the present invention analyzes the picture data supplied thereto (For an example, one frame of picture data) for controlling polarities of the pixel voltages to be forwarded from the upper data drive ICs UDD1~UDDn and the bottom data drive ICs BDD1~BDDn. With reference to the result of the analysis, the polarity inversion control signal POL which controls the polarities of the pixel voltages from the upper data drive ICs UDD1~UDDn and the polarity inversion control signal POL which controls the polarities of the pixel voltages from the bottom data drive ICs BDD1~BDDn are forwarded. The polarity inversion control signals POL are supplied to the upper data drive ICs UDD1~UDDn and the bottom data drive ICs BDD1~BDDn.

This will be described in more detail below.

Figure 10:
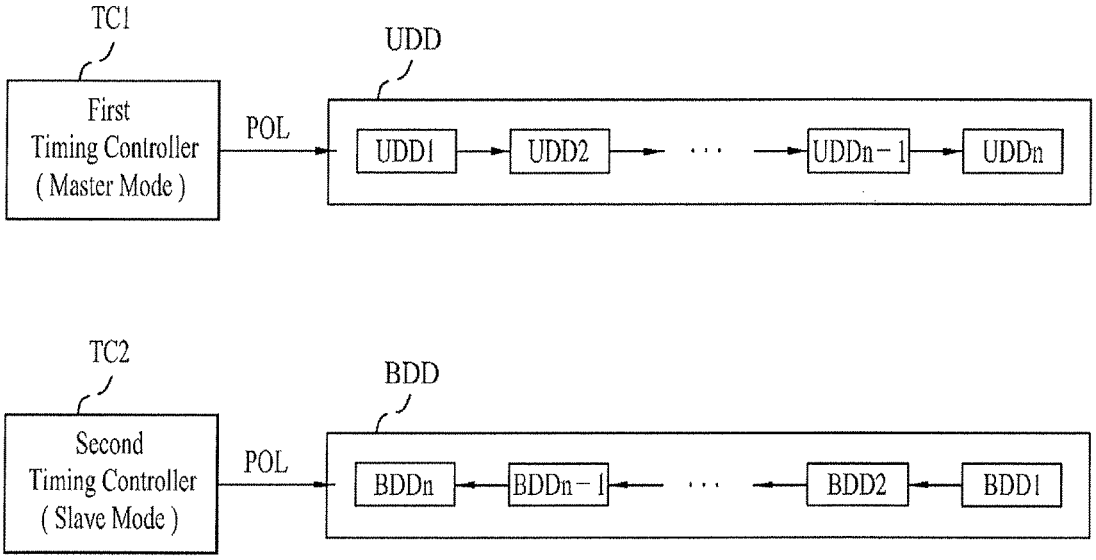
FIG. 10 illustrates a diagram showing a forwarding mode of a polarity inversion control signal in accordance with a first preferred embodiment of the present invention.

FIG. 10 illustrates a diagram showing a forwarding mode of a polarity inversion control signal in accordance with a first preferred embodiment of the present invention.

Referring to FIG. 10, the two timing controllers forward the polarity inversion control signals POL, individually. In detail, the first timing controller TC1 analyzes characteristics of the picture data (For an example, picture data in one frame) applied thereto, and generates the polarity inversion control signal POL with reference to a result of the analysis. The polarity inversion control signal POL from the first timing controller TC1 is supplied to the upper data drive ICs UDD1~UDDn.

The second timing controller TC2 analyzes characteristics of the picture data (For an example, picture data in one frame) applied thereto, and generates the polarity inversion control signal POL with reference to a result of the analysis. The polarity inversion control signal POL from the second timing controller TC2 is supplied to the bottom data drive ICs BDD1~BDDn.

In this instance, the picture data supplied to the first and second timing controllers TC1 and TC2 are identical picture data.

In this instance, the first and second timing controllers TC1 and TC2 are operated different from each other according to modes thereof as follows.

For an example, referring to FIG. 10, if the first timing controller TC1 is operated in the master mode, and the second timing controller TC2 is operated in the slave mode, a mode of the polarity inversion control signal POL to be forwarded from the second timing controller TC2 can be controlled by the first timing controller TC1 which is in the master mode. In this case, the first timing controller TC1 in the master mode analyzes the picture data to be applied thereto and selects the polarity inversion control signal POL to be forwarded therefrom and the polarity inversion control signal POL to be forwarded from the second timing controller TC2 with reference to a result of the analysis. Specifically, the first timing controller TC1 in the master mode controls the second timing controller TC2 to select the polarity inversion control signal POL identical to the polarity inversion control signal POL to be forwarded therefrom, or the second timing controller TC2 to select the polarity inversion control signal POL having an inverted phase from the polarity inversion control signal POL to be forwarded therefrom. In this instance, the second timing controller TC2 does not analyze the picture data to be applied thereto.

In the meantime, if the second timing controller TC2 is in the master mode and the first timing controller TC1 is in the slave mode, the second timing controller TC2 in the master mode analyzes the picture data to be applied thereto, and selects the polarity inversion control signal POL to be forwarded therefrom and the polarity inversion control signal POL to be forwarded from the first timing controller TC1 with reference to the result of the analysis. Specifically, the second timing controller TC2 in the master mode controls the first timing controller TC1 to select the polarity inversion control signal POL identical to the polarity inversion control signal POL to be forwarded therefrom, or the first timing controller TC1 to select the polarity inversion control signal POL having an inverted phase from the polarity inversion control signal POL to be forwarded therefrom. In this instance, the first timing controller TC1 does not analyze characteristics of the picture data to be applied thereto.

Figure 11:
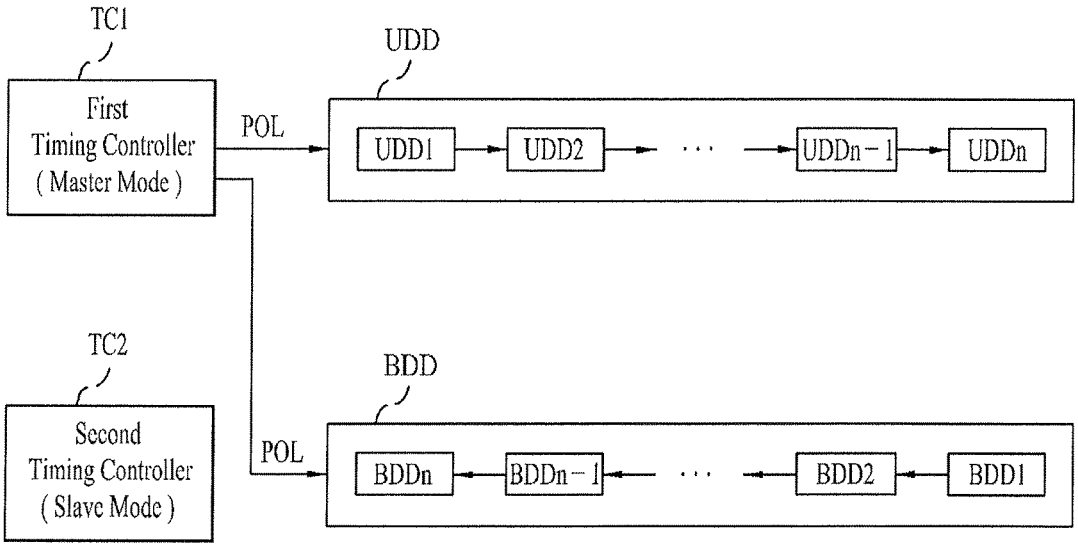
FIG. 11 illustrates a diagram showing a forwarding mode of a polarity inversion control signal in accordance with a second preferred embodiment of the present invention.

FIG. 11 illustrates a diagram showing a forwarding mode of a polarity inversion control signal in accordance with a second preferred embodiment of the present invention.

Referring to FIG. 11, either one of the two timing controllers forwards two polarity inversion control signals POL, while the other one does not forward the polarity inversion control signal POL. One of the polarity inversion control signals POL forwarded from the one timing controller is supplied to the upper data drive ICs UDD1~UDDn, and the other one of the polarity inversion control signal POL is supplied to the bottom data drive ICs BDD1~BDDn.

For an example, referring to FIG. 11, if the first timing controller TC1 is operated in the master mode, and the second timing controller TC2 is operated in the slave mode, the first timing controller TC1 operated in the master mode analyzes characteristics of the picture data (For an example, the picture data in one frame) to be applied thereto, and forwards the polarity inversion control signal POL to be supplied to the upper data drive ICs UDD1~UDDn and the polarity inversion control signal POL to be supplied to the bottom data drive ICs BDD1~BDDn as a result of the analysis, together. In this instance, the Second timing controller TC2 does not analyze characteristics of the picture data to be applied thereto.

Opposite to this, if the second timing controller TC2 is operated in the master mode, and the first timing controller TC1 is operated in the slave mode, the second timing controller TC2 operated in the master mode analyzes characteristics of the picture data (For an example, the picture data in one frame) to be applied thereto, and forwards the polarity inversion control signal POL to be supplied to the bottom data drive ICs BDD1~BDDn and the polarity inversion control signal POL to be supplied to the upper data drive ICs UDD1~UDDn as a result of the analysis, together.

In this instance, the first timing controller TC1 does not analyze the characteristics of the picture data to be applied thereto.

Figure 12:
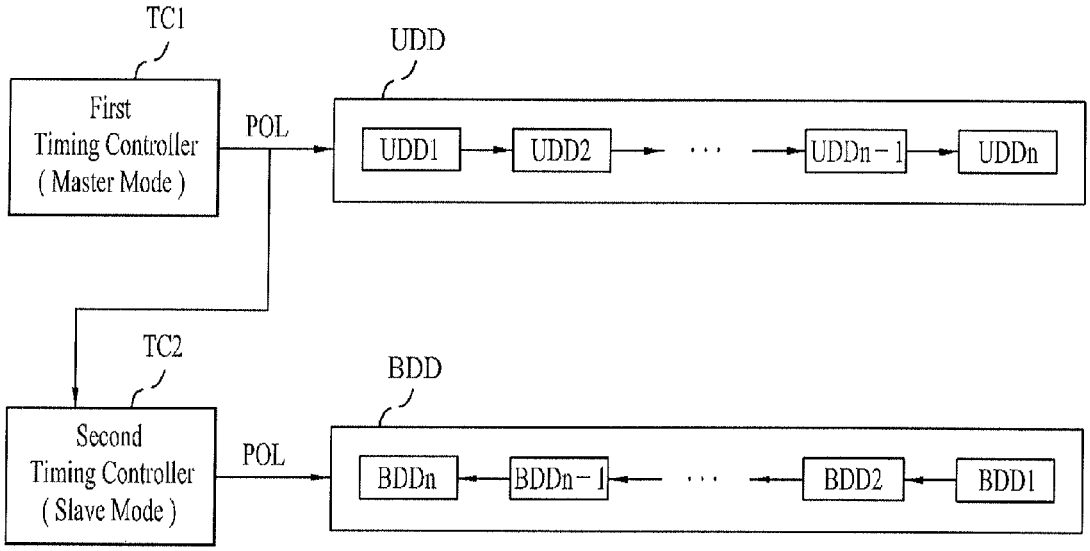
FIG. 12 illustrates a diagram showing a forwarding mode of a polarity inversion control signal in accordance with a third preferred embodiment of the present invention.

FIG. 12 illustrates a diagram showing a forwarding mode of a polarity inversion control signal in accordance with a third preferred embodiment of the present invention.

Referring to FIG. 12, of the two timing controllers, while one of the two timing controllers generates and forwards the polarity inversion control signal POL individually, the other one timing controller receives the polarity inversion control signal POL from the one timing controller and forwards the same as it is or after inverting a phase thereof.

For an example, referring to FIG. 12, if the first timing controller TC1 is operated in the master mode, and the second timing controller TC2 is operated in the slave mode, the first timing controller TC1 operated in the master mode analyzes characteristics of the picture data (For an example, the picture data in one frame) to be applied thereto, and generates the polarity inversion control signal POL with reference to a result of the analysis, and supplies the same to the upper data drive ICs UDD1~UDDn and the second timing controller TC2. The second timing controller TC2 receives the polarity inversion control signal POL from the first timing controller TC1 and forwards the polarity inversion control signal POL as it is or after inverting a phase thereof under the control of the first timing controller TC1. The polarity inversion control signal POL forwarded from the second timing controller TC2 is supplied to the bottom data drive ICs BDD1~BDDn. In this instance, the second timing controller TC2 does not analyze the characteristics of the picture data to be applied thereto.

Opposite to this, if the second timing controller TC2 is operated in the master mode, and the first timing controller TC1 is operated in the slave mode, the second timing controller TC2 operated in the master mode analyzes characteristics of the picture data (For an example, the picture data in one frame) to be applied thereto, and generates the polarity inversion control signal POL with reference to a result of the analysis, and supplies the same to the bottom data drive ICs BDD1~BDDn and the first timing controller TC1. The first timing controller TC1 receives the polarity inversion control signal POL from the second timing controller TC2 and forwards the polarity inversion control signal POL as it is or after inverting a phase thereof under the control of the second timing controller TC2. The polarity inversion control signal POL forwarded from the first timing controller TC1 is supplied to the upper data drive ICs UDD1~UDDn. In this instance, the first timing controller TC1 does not analyzes the characteristics of the picture data to be applied thereto.

Since the two timing controllers do not generate polarity inversion control signals POL independent from each other, but the polarity inversion control signal POL to be forwarded from the other timing controller is generated by using the polarity inversion control signal POL forwarded from the one timing controller, the third embodiment of the present invention can solve the problem of synchronization liable to take place when the two timing controllers generate the polarity inversion control signals POL independent from each other.

The polarity inversion control signal POL forwarding modes described with reference to FIGS. 10~12 can be applied to the one dot inversion type picture display shown in FIG. 5 or the variant two don inversion type picture display shown in FIG. 6.

In the meantime, the polarity inversion control signal POL forwarding modes described with reference to FIGS. 10~12 can also be applied to the interface type in which the polarity inversion control signal is transmitted together with the picture data.

As has been described, the liquid crystal display device of the present invention has the following advantages.

First, the supply of identical pixel voltages to both sides of each of the data lines can improve charge rates to the data line and the pixels.

Second, the control of the phases of the polarity inversion control signals from the first and second timing controllers according to characteristics of the picture data can improve a picture quality.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A liquid crystal display device comprising:

a display panel that displays a picture thereon;

first to (n)th upper data drive ICs that apply pixel voltages in a first driving direction to one end of each data line in the display panel, respectively, the first to (n)th upper data drive ICs being arranged in this order from one of a left side and a right side of the display panel to the other one of the left and right sides of the display panel, wherein n is a natural number greater than 1;

first to (n)th bottom data drive ICs that apply pixel voltages in a second driving direction to the other end of each data line, respectively, the first to (n)th bottom data drive ICs being arranged in this order from the other one of the left and right sides of the display panel to the one of the left and right sides of the display panel, wherein the first driving direction and the second driving direction are opposite driving directions, wherein one of the first to (n)th upper data drive ICs and a corresponding one of the first to (n)th bottom data drive ICs are connected to the same data line for each of the plurality of scan lines;

a first timing controller that generates an upper data control signal and supplies picture data and the upper data control signal to the upper data drive ICs for controlling operation of the upper data drive ICs, wherein the first timing controller controls the upper data drive ICs to supply picture data from the first upper data drive IC positioned at the one of the left and right sides of the display panel to the (n)th upper data drive IC positioned at the other one of the left and right sides of the display panel; and a second timing controller that generates a bottom data control signal and supplies the same picture data as the first timing controller and the bottom data control signal to the bottom data drive ICs for controlling operation of the bottom data drive ICs, wherein the second timing controller controls the bottom data drive ICs to supply the same picture data from the first bottom data drive IC positioned at the other one of the left and right sides of the display panel to the (n) the bottom data drive IC positioned at the one of the left and right sides of the display panel, wherein one of the first timing controller and the second timing controller is operated in a master mode, and the other timing controller is operated in a slave mode, for controlling the supply of the picture data in one of the first and second driving directions, respectively, and wherein for each pixel, the upper data drive ICs apply a pixel voltage with a predetermined polarity to one end of data line and the bottom data drive ICs apply a pixel voltage with a predetermined polarity to the other end of the data line, such that the same pixel voltage with the same polarity is applied to the same pixel from both ends of any one data line during a frame.

2. The liquid crystal display device as claimed in claim 1, wherein the first timing controller generates a polarity inversion control signal for controlling the polarities of the pixel voltages to be forwarded from the upper data drive ICs in the first driving direction and supplies the same to the upper data drive, the second timing controller generates a polarity inversion control signal for controlling the polarities of the pixel voltages to be forwarded from the bottom data drive ICs in the second driving direction and supplies the same to the bottom data drive, and the timing controller operated in the master mode analyzes the picture data on one frame, and with reference to a result of the analysis, selects the polarity inversion control signal of the timing controller operated in the master mode and the polarity inversion control signal of the timing controller operated in the slave mode.

3. The liquid crystal display device as claimed in claim 2, wherein the timing controller operated in the master mode controls the timing controller operated in the slave mode such that the timing controller operated in the slave mode selects the polarity inversion control signal having a phase identical to, or inverse to, the polarity inversion control signal to be forwarded from the timing controller operated in the master mode.

4. The liquid crystal display device as claimed in claim 1, wherein the first timing controller generates the polarity inversion control signal which controls polarities of the pixel voltages to be forwarded from the upper data drive ICs to the upper data drive ICs in the first driving direction, and generates the polarity inversion control signal which controls the polarities of the pixel voltages to be forwarded from the bottom data drive ICs to the bottom data drive ICs in the second driving direction, the first timing controller is operated in a master mode, and the second timing controller is operated in a slave mode, and the first timing controller analyzes characteristics of the picture data on one frame, and forwards the polarity inversion control signal to be supplied to the upper data drive ICs and the polarity inversion control signal to be supplied to the bottom data drive ICs with reference to a result of the analysis, together.

5. The liquid crystal display device as claimed in claim 1, wherein the second timing controller forwards the polarity inversion control signal which controls polarities of the pixel voltages to be forwarded from the upper data drive ICs to the upper data drive ICs, and forwards the polarity inversion control signal which controls the polarities of the pixel voltages to be forwarded from the bottom data drive ICs to the bottom data drive ICs, the second timing controller is operated in a master mode, and the first timing controller is operated in a slave mode, and the second timing controller analyzes characteristics of the picture data applied thereto, and forwards the polarity inversion control signal to be supplied to the upper data drive ICs and the polarity inversion control signal to be supplied to the bottom data drive ICs with reference to a result of the analysis, together.

6. The liquid crystal display device as claimed in claim 1, wherein the first timing controller generates a polarity inversion signal which controls the polarities of the pixel voltages to be forwarded from the upper data drive ICs in the first driving direction and supplies the same to the upper data drive ICs, the second timing controller generates a polarity inversion signal which controls the polarities of the pixel voltages to be forwarded from the bottom data drive ICs in the second driving direction and supplies the same to the bottom data drive ICs, the timing controller operated in the master mode analyzes characteristics of the picture data on one frame, generates the polarity inversion control signal with reference to a result of the analysis, and supplies the generated polarity inversion control signal to the upper data drive ICs and the timing controller operated in the slave mode, and the timing controller operated in the slave mode receives the polarity inversion control signal from the timing controller operated in the master mode, and forwards a polarity inversion control signal having a predetermined phase under the control of the timing controller operated in the master mode.

7. The liquid crystal display device as claimed in claim 2, wherein the polarity inversion control signals forwarded from the first and second timing controllers have inverse phases with respect to each other when the polarities of the pixel voltages supplied to the pixels from the upper and bottom data drive ICs are inverted in one dot inversion type.

8. The liquid crystal display device as claimed in claim 2, wherein the polarity inversion control signals forwarded from the first and second timing controllers have coinciding phases in odd numbered horizontal periods and inverse phases with respect to each other in even numbered horizontal periods when the polarities of the pixel voltages supplied to the pixels from the upper and bottom data drive ICs are inverted in two dot inversion type in which the pixel voltages being supplied to the pixels on the odd numbered vertical lines have the polarities inverted at every one pixel and the pixel voltages being supplied to the pixels on the even numbered vertical lines have the same polarities.

9. A method of driving a liquid crystal display device comprising:

generating an upper data control signal and supplying picture data and the upper data control signal from a first timing controller to first to (n)th upper data drive ICs for controlling operation of the upper data drive ICs, the first to (n)th upper data drive ICs being arranged in this order from one of a left side and a right side of a display panel to the other side of the display panel, wherein n is a natural number greater than 1;

generating a bottom data control signal and supplying the same picture data as the first timing controller and the bottom data control to first to (n)th bottom data drive ICs for controlling operation of the bottom data drive ICs, the first to (n)th bottom data drive ICs being arranged in this order from the other one of the left and right sides of the display panel to the one of the left and right sides of the display panel;

applying pixel voltages from the upper data drive ICs in a first driving direction to one end of each data line in the display panel; and applying pixel voltages from the bottom data drive ICs in a second driving direction to one end of each data line in the display panel, wherein the first driving direction and the second driving direction are opposite directions, wherein one of the first to (n)th upper data drive ICs and a corresponding one of the first to (n)th bottom data drive ICs are connected to the same data line, wherein the first timing controller controls the upper data drive ICs to supply picture data from the first upper data drive IC positioned at the one of the left and right sides of the display panel to the (n)th upper data drive IC positioned at the other one of the left and right sides of the display panel, and the second timing controller controls the bottom data drive ICs to supply the same picture data as the first timing controller from the first bottom data drive IC positioned at the other one of the left and right sides of the display panel to the (n)th bottom data drive IC positioned at the one of the left and right sides of the display panel, wherein the one of the first timing controller and the second timing controller is operated in a master mode, and the other timing controller is operated in a slave mode for controlling the supply of picture data in one of the first and the second driving directions, respectively, and wherein, for each pixel, the upper data drive ICs apply a pixel voltage with a predetermined polarity to one end of each data line and the bottom data drive ICs apply a pixel voltage with a predetermined polarity to the other end of each data line, such that the same pixel voltage with the same polarity is applied to the same pixel from both ends of any one of data line during a frame.

10. The method as claimed in claim 9, wherein the first timing controller generates a polarity control inversion signal for controlling the polarities of the pixel voltages to be forwarded from the upper data drive ICs in the first driving direction and supplies the generated polarity control inversion signal to the upper data drive ICs, the second timing controller generates a polarity inversion control signal for controlling the polarities of the pixel voltages to be forwarded from the bottom data drive ICs in the second driving direction and supplies the generated polarity inversion control signal to the bottom data drive ICs, and the timing controller operated in the master mode analyzes the picture data on one frame, and with reference to a result of the analysis, selects the polarity inversion control signal of the timing controller operated in the master mode and the polarity inversion control signal of the timing controller operated in the slave mode.

11. The method as claimed in claim 10, wherein the timing controller operated in the master mode controls the timing controller operated in the slave mode such that the timing controller operated in the slave mode selects the polarity inversion control signal having a phase identical to, or inverse to, the polarity inversion control signal to be forwarded from the timing controller operated in the master mode.

12. The method as claimed in claim 9, wherein the first timing controller generates a polarity inversion control signal which controls polarities of the pixel voltages to be forwarded from the upper data drive ICs to the upper data drive ICs in the first driving direction, and forwards the polarity inversion control signal which controls the polarities of the pixel voltages to be forwarded from the bottom data drive ICs to the bottom data drive ICs in the second driving direction, the first timing controller is operated in a master mode, and the second timing controller is operated in a slave mode, and the first timing controller analyzes characteristics of the picture data on one frame, and forwards the polarity inversion control signal to be supplied to the upper data drive ICs and the polarity inversion control signal to be supplied to the bottom data drive ICs with reference to a result of the analysis, together.

13. The method as claimed in claim 9, wherein the second timing controller forwards the polarity inversion control signal which controls polarities of the pixel voltages to be forwarded from the upper data drive ICs to the upper data drive ICs, and forwards the polarity inversion control signal which controls the polarities of the pixel voltages to be forwarded from the bottom data drive ICs to the bottom data drive ICs, the second timing controller is operated in a master mode, and the first timing controller is operated in a slave mode, and the second timing controller analyzes characteristics of the picture data applied thereto, and forwards the polarity inversion control signal to be supplied to the upper data drive ICs and the polarity inversion control signal to be supplied to the bottom data drive ICs with reference to a result of the analysis, together.

14. The method as claimed in claim 9, wherein the first timing controller generates a polarity inversion signal which controls the polarities of the pixel voltages to be forwarded from the upper data drive ICs and supplies the same to the upper data drive ICs in the first driving direction, the second timing controller generates a polarity inversion signal which controls the polarities of the pixel voltages to be forwarded from the bottom data drive ICs and supplies the same to the bottom data drive ICs in the second driving direction, the timing controller operated in the master mode analyzes characteristics of the picture data on one frame, generates the polarity inversion control signal with reference to a result of the analysis, and supplies the generated polarity inversion control signal to the upper data drive ICs and the timing controller operated in the slave mode, and the timing controller operated in the slave mode receives the polarity inversion control signal from the timing controller operated in the master mode, and forwards the polarity inversion control signal having a predetermined phase under the control of the timing controller operated in the master mode.

15. The method as claimed in claim 10, wherein the polarity inversion control signals forwarded from the first and second timing controllers have inverse phases to each other when the polarities of the pixel voltages from the upper and bottom data drive ICs are inverted in one dot inversion type.

16. The method as claimed in claim 10, wherein the polarity inversion control signals forwarded from the first and second timing controllers have coinciding phases in odd numbered horizontal periods and inverse phases with respect to each other in even numbered horizontal periods when the polarities of the pixel voltages from the upper and bottom data drive ICs are inverted in two dot inversion type in which the pixel voltages being supplied to the pixels on the odd numbered vertical lines have the polarities inverted at every one pixel and the pixel voltages being supplied to the pixels on the even numbered vertical lines have the same polarities.

17. The liquid crystal display device as claimed in claim 1, wherein the first to (n)th upper data drive ICs are identical to the first to (n)th bottom data drive ICs.

* * * * *